United States Patent [19]

Börebäck

[11] 4,006,926

[45] Feb. 8, 1977

[54] FASTENING DEVICE FOR WINGS, SPECIALLY FOR WINDOWS OR DOORS

[76] Inventor: Stig Bertil Börebäck, S-24013 Genarp, Sweden

[22] Filed: June 18, 1975

[21] Appl. No.: 587,999

[52] U.S. Cl. ..... 292/262; 292/252

[51] Int. Cl.[2] ..... E05C 17/04

[58] Field of Search ..... 292/262, 277, 269, 252, 292/DIG. 50, 15

[56] References Cited

UNITED STATES PATENTS

| | | | |
|---|---|---|---|
| 1,544,387 | 6/1925 | Fulton | 292/273 X |
| 3,129,024 | 4/1964 | Schuessler et al. | 292/15 |

*Primary Examiner*—Richard E. Moore
*Attorney, Agent, or Firm*—Bucknam and Archer

[57] ABSTRACT

A fastening device for wings, specially for windows, for lockable closure and lockable holding of the wing in one or more opened positions, which device comprises a movable arm which has one end connected to the wing of the window. The arm forms a channel and has a longitudinal slot in communication with the channel, and a plurality of spring loaded locking means are placed in a row in the channel. Upon introduction of a latch through the slot in an upward direction into the channel between two locking means, the latter are moved apart under spring action, whereupon at least one of the two locking means engages an engagement surface of the latch inserted in the channel. A screw spindle is screwed into the other end of the arm, and the two locking means are arrestable, in the position in which they engage the latch introduced into the channel, by such a displacement of the screw spindle that the spring action is abolished.

4 Claims, 3 Drawing Figures

FASTENING DEVICE FOR WINGS, SPECIALLY FOR WINDOWS OR DOORS

BACKGROUND OF THE INVENTION

The invention relates to a fastening device for wings, specially for windows, doors and like members to permit lockable closure and lockable holding of said wing in one or more opened positions, which device comprises a movable arm connected at one end to a wing of a window or door and having two pertaining parts, latches each of which is formed with an engagement surface, and a locking device with key disposed at the other end of the arm.

The object of the present invention is to provide an easily operable and child-proof fastening device of the type indicated.

SUMMARY OF THE INVENTION

According to the invention, the arm of the fastening device consists of a profile which forms a channel and at the underside has a longitudinal slot which is in communication with the channel, a plurality of spring loaded locking means are placed in a row in the channel, and upon introduction of one of the latches through the slot upwardly into the channel between two locking means the latter are moved apart against spring action in the longitudinal direction of the arm, whereupon at least one of said two locking means engages the engagement surface of the latch introduced into the channel, and a screw spindle is screwed into said other end of the arm, said two locking means being arrestable, in the position in which they engage the latch introduced into the channel, by such a displacement of the screw spindle with the aid of the key that the spring action is abolished.

The fastening device according to the invention can be used without any particular measures or modifications as a conventional device for holding a wing open merely by a hooking function when it is not deemed that a locking of the wing is called for, as there is no safety risk or other danger of an unauthorized opening of the wing.

An embodiment of the invention will be described in greater detail hereinbelow and with reference to the accompanying drawing.

DETAILED DESCRIPTION

Figure 1:
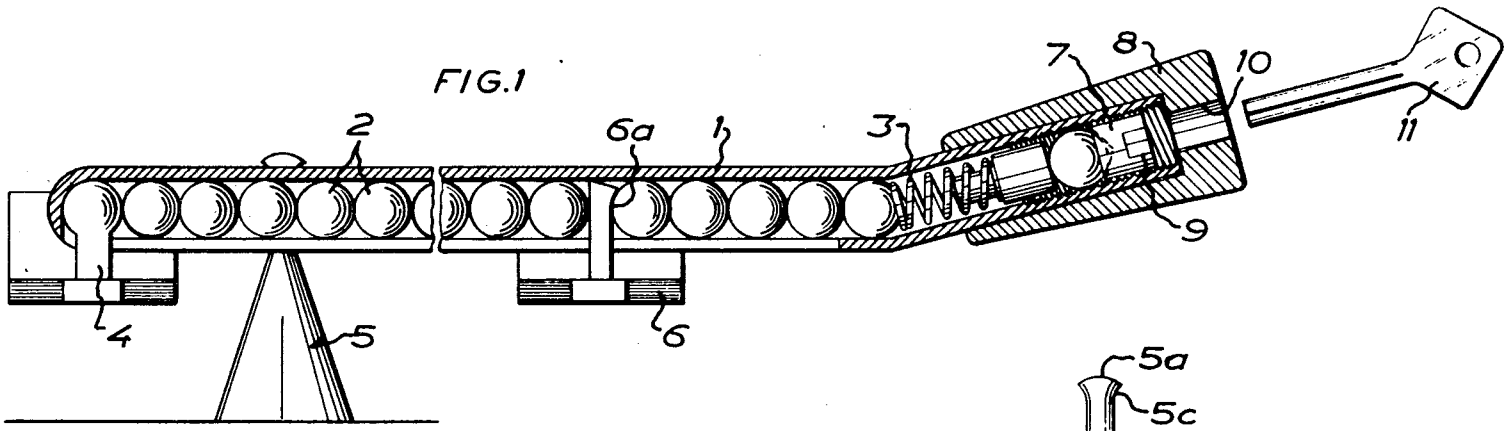
FIG. 1 shows a fastening device as seen from the sdie and in section.
Figure 3:
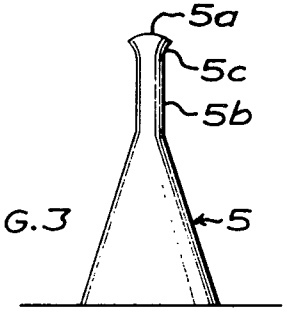
FIG. 3 shows a latch of the fastening device in FIG. 1.

An arm 1 of the fastening device consists of a profile which at the underside has a longitudinal slot, the inner portion of the profile being so designed that its cross-section will be a circular arc the centre angle of which is greater than that of the semi-circular arc. In the interior of the profile arm 1 a number of spherical balls 2 are placed in a row. The radii of the balls are adapted to the inner portion of the profile in such a way that the balls can be moved without difficulty in the longitudinal direction, and the number of the balls varies according to the length of the arm 1. The balls are kept tightly packed by a spring device 3 at one end of the profile. At the other end the arm 1 terminates in a joint means, preferably a ball and socket joint 4, which is intended to be fixed to the movable member, the wing, of a window or door.

The fastening device includes two latches 5, 6 one of which 5 is mounted on the frame of a window or a door and intended for use in holding the window in an opened position while the other latch 6 is mounted on the wing of a window or door and intended to lock it in closed position. The first latch 5 is formed with a convex head **5*a* and a cylindrical stem 5*b* having an arcuate engagement surface 5*c*, while the second latch 6 is formed as a cylindrical body having an oblique bevel at the upper end and an arcuate engagement surface 6*a*. The radius of the arcuate engagement surfaces of the two latches correspond to the radii of the balls 2 located in the arm 1** of the fastening device.

The arm 1 is formed at said one end as an inwardly threaded cylindrical body in which a screw spindle 7 is arranged and to which a handle 8 is fixed. At the outer end the spindle 7 has a recess 9 the shape of which corresponds to the shape of a key 11 insertable in the recess through a hole 10 in the handle 8.

Figure 2:
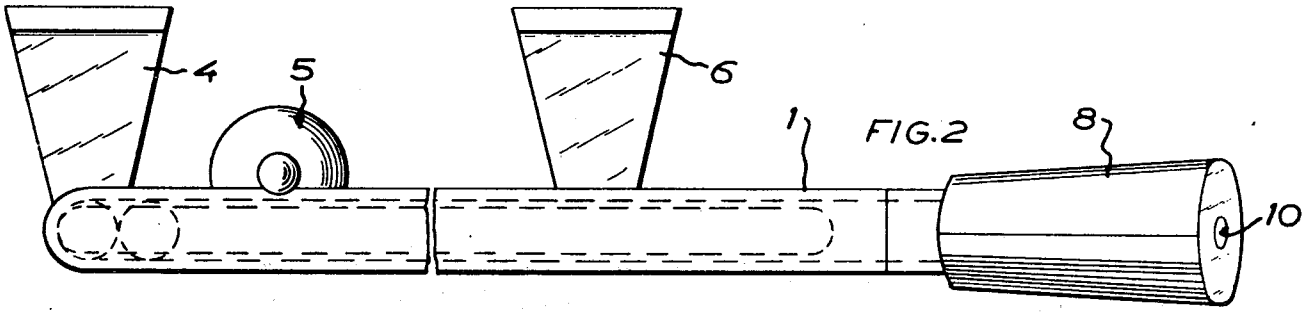
FIG. 2 shows the fastening device in FIG. 1 as seen in top plan view.

In the position illustrated in FIGS. 1 and 2, for instance the wing of a window connected to the ball and socket joint 4 is in closed, latched position. The latch 5 is situated behind the arm 1 (FIG. 1) and thus prevents the wing from being opened. The latch 6, on the other hand, is inserted between two balls 2 in the arm 1, a ball 2 situated adjacent the latch 6 engaging under the action of the spring device 3 with the engagement surface **6*a*** of the latch.

Should further latching safety be desired the key 11 is inserted in the recess 9 of the spindle 7 through the hole 10 in the handle 8 and is turned clockwise until a stop is reached. If the key 11 is not turned counterclockwise the arm 1 cannot be raised from the latch 6 since the engagement of the balls with the engagement surface **6*a*** of the latch is not resilient any more.

For opening of the wing the key 11 is turned counterclockwise so as to permit raising the arm 1 from the latch 6. When the arm 1 has been raised the wing can be opened in the desired degree and then held in the desired position in that the arm 1 is pressed down over the latch 5 in such a way that the latter penetrates between two balls 2. These balls are thereby first moved apart and because of the action of the spring device 3 the balls then engage the engagement surface **5*c* of the latch 5. Further latching safety is realized in the same way as before with the aid of the key 11**.

From the foregoing it will be appreciated by the artisan that the invention provides a fastening device for securing a moveable member such as a window or door in a selected position with respect to a reference structure, such as the floor or a wall. This device includes means 1 defining an elongated rigid channel pivotally connected at one end as by the joint 4 to the moveable member, this channel having a longitudinally extending slot as better seen from FIGS. 1 and 2. A plurality of locking members, expediently in the form of spherical balls 2 are contained within the channel and arranged in tandem for limited movement longitudinally relative to said channel. The latch member 5 which is connected to the reference structure, in this case a floor, is disposed for insertion through the slot of the channel and between a selected pair of locking members 2. Compression means, expediently in the form of the elements 7, 8, 9, 10 and 11 are provided at the other end of the channel, opposite the pivot 4, and are operable to engage the locking member 2 nearest said other end to push all of the locking members 2 together into a locking configuration in which said locking members 2 are constrained against longitudinal movement and the latch member 5 is captured by the pair of locking members 2 between which it is inserted.

As will appear from the above description of the function of the fastening device, said device makes it possible to hold the wing of a window or door in a great many opened positions at intervals corresponding to the ball diameter. An absolutely child-proof latching is obtained both in the opened and closed positions.

What I claim and desire to secure by Letters Patent is:

1. A fastening device for a wing, to permit lockable closure and lockable holding of said wing in at least one opened position relative to a stationary part, which device comprises an arm having a profile which forms a channel and at the underside has a longitudinal slot in communication with the channel; means for pivotally connecting one end of said arm to said wing; a plurality of locking members placed in a row in the channel of said arm and movable in the channel longitudinally of said arm; a screw spindle axially screwed into the other end of said arm; a key for turning said screw spindle; a compression spring placed in the channel of said arm between said locking members and said screw spindle and acting in the longitudinal direction of said arm; two latches one of which is adapted for mounting on said stationary part and the other on said wing; and a portion formed on each of said latches and introducible through said slot upwardly into said channel between two adjacent locking members, to move said two adjacent locking members apart against the action of said compression spring, and having an engagement surface which, upon introduction of said portion between said two adjacent locking members, is adapted to engage at least one of said two adjacent locking members, said portion being arrestable in the portion in which said engagement surface engages said locking members, by such turning movement of the screw spindle with the aid of the key that the spring action is abolished.

2. A fastening device for securing a moveable member in a selected position with respect to a reference structure, which device comprises means defining an elongated rigid channel pivotally connectable at one end to the moveable member, said channel having a longitudinally extending slot, a plurality of locking members contained within said channel and arranged in tandem for limited movement longitudinally relative to said channel, a latch member connectable to said reference structure and disposed for insertion through said slot and between a selected pair of said locking members; and compression means at the other end of said channel operable to engage the locking member nearest said other end and push all of said locking members together into a locking configuration in which said locking members are constrained against longitudinal movement and said latch member is captured by said pair of locking members, thereby securing the moveable member in said selected position.

3. A fastening device as claimed in claim 1, wherein the locking members are spherical balls and the cross-section of the channel is of a shape corresponding to that of the balls.

4. A fastening device as claimed in claim 1 wherein the locking members are rollers and the cross-section of the channel is of a shape corresponding to that of the rollers.

* * * * *